United States Patent [19]

Laursen

[11] 4,344,624

[45] Aug. 17, 1982

[54] PRACTICE PUTTING TRAINER

[76] Inventor: Paul D. Laursen, 1620 Buckingham, Lincoln Park, Mich. 48146

[21] Appl. No.: 225,128

[22] Filed: Jan. 14, 1981

[51] Int. Cl.[3] ..... A63B 69/36

[52] U.S. Cl. ..... 273/176 F; 273/178 R; 273/176 B; 273/185 R

[58] Field of Search ..... 273/176 F, 176 FA, 176 FB, 273/183 A, 177 R, 178 R, 176 B, 192, 184 A, 185 R

[56] References Cited

U.S. PATENT DOCUMENTS

| | | | |
|---|---|---|---|
| 1,427,538 | 8/1922 | Long | 273/186 C |
| 1,783,211 | 12/1930 | Baldwin | 273/183 A |
| 2,103,502 | 12/1937 | Webster | 273/188 |
| 2,456,813 | 12/1948 | Cavins | 273/176 F |
| 2,710,757 | 6/1955 | Chong | 273/183 A |
| 2,858,133 | 10/1958 | Self | 273/192 |
| 3,038,726 | 6/1962 | Hesidence | 273/195 R |
| 3,156,471 | 11/1964 | Bibeau | 273/176 F |
| 3,572,720 | 3/1971 | Berg | 273/186 C X |
| 3,861,524 | 1/1975 | Coleman | 273/176 FB X |
| 3,885,796 | 5/1975 | King | 273/186 C |
| 3,934,874 | 1/1976 | Henderson | 273/183 A X |
| 3,934,882 | 1/1976 | Whittaker | 273/183 A |
| 4,153,255 | 5/1979 | Woodson | 273/186 A |

*Primary Examiner*—George J. Marlo

*Attorney, Agent, or Firm*—Basile, Weintraub & Hanlon

[57] ABSTRACT

A practice putting trainer for golfers is disclosed. The practice putting trainer of the present invention comprises an elongated, narrow, planar base having a width substantially equal to the diameter of a golf ball and sufficient stiffness to support a golf ball without perceptible deflection with a putting surface along its upper surface. A cup for receiving the golf ball is positioned at one end of the base. A ball rest for retaining the golf ball on the putting surface until struck by a putter is included on the bases. The ball rest is adjustably positioned along the length of the base to vary the length of the putt. A recess is provided in a forward edge of the ball rest to prevent transverse movement of the ball until struck by a putter.

9 Claims, 4 Drawing Figures

PRACTICE PUTTING TRAINER

BACKGROUND OF THE INVENTION

I. Field of the Invention

The present invention generally relates to golf teaching devices and, in particular, the present invention is concerned with a training device for improving a golfer's ability to putt.

II. Description of the Prior Art

Practice devices to aid the golfer in improving his putting are known in the art. Examples of golf practicing apparatus known in the prior art are disclosed in U.S. Pat. Nos. 1,427,538; 2,103,502; 2,456,813; 2,858,133; 3,038,726; 3,572,720; 3,885,796; 3,934,874; and 4,153,255. These patents are relevent to the Applicant's invention in that they represent the closest prior art for devices that may be utilized to improve a golfer's putting.

SUMMARY OF THE INVENTION

The present invention, which will be described in greater detail hereinafter, comprises a practice putting trainer including an elongated, narrow planar base with a cup recessed to receive a golf ball at one end and a flat putting surface formed along an upper portion thereof. The base is structured to have sufficient stiffness to support a golf ball without perceptible deflection as the golf ball rolls therealong. An edge of the cup is rounded slightly to encourage the entry of a properly struck golf ball having the correct speed, and to allow an improperly struck golf ball having too much speed to enter and leave the cup. A ball rest is provided having a top wall abutting the putting surface, with the ball rest adapted to be slidingly engaged with the base for movement along the putting surface. A forward edge of the ball rest is recessed to adjustably position the golf ball in the center of the putting surface prior to being struck by the putter.

The base has a width that is approximately equal to or slightly larger than the diameter of a golf ball, and a properly struck golf ball will roll along the putting surface and drop into the cup. If the golfer, when using the device, uses an incorrect stroke and causes the ball to spin about its vertical axis, the ball will quickly move to the side and fall from the putting surface. Other putting errors are quickly detected and corrected by a golfer using the device of the present invention.

It is therefore a primary object of the present invention to provide a new and improved practice putting trainer.

It is a further object of the present invention to provide such a practice putting trainer which uses a narrow putting surface along which the ball rolls enabling the golfer to quickly detect and correct putting errors.

It is yet another object of the present invention to provide a new and improved practice putting trainer that utilizes a cup having a slightly rounded edge so that proper ball velocity is required to sink the ball in the cup.

It is a further object of the present invention to provide a practice putting trainer which includes an adjustable ball rest movable along the putting surface to retain the ball prior to the ball being struck by a putter and to vary the length of the putt.

It is another object of the present invention to provide an easily transported device that adds interest to practicing short putts.

Further objects, advantages, and applications of the present invention will become apparent to those skilled in the art of golf practice putting trainers when the accompanying description of one example of the best mode contemplated for practicing the invention is read in conjunction with the accompanying drawing.

BRIEF DESCRIPTION OF THE DRAWING

In the drawing, like numbers refer to like parts throughout the several views and wherein.

DESCRIPTION OF THE PREFERRED EMBODIMENT

Figures 1, 2, 3, 4:
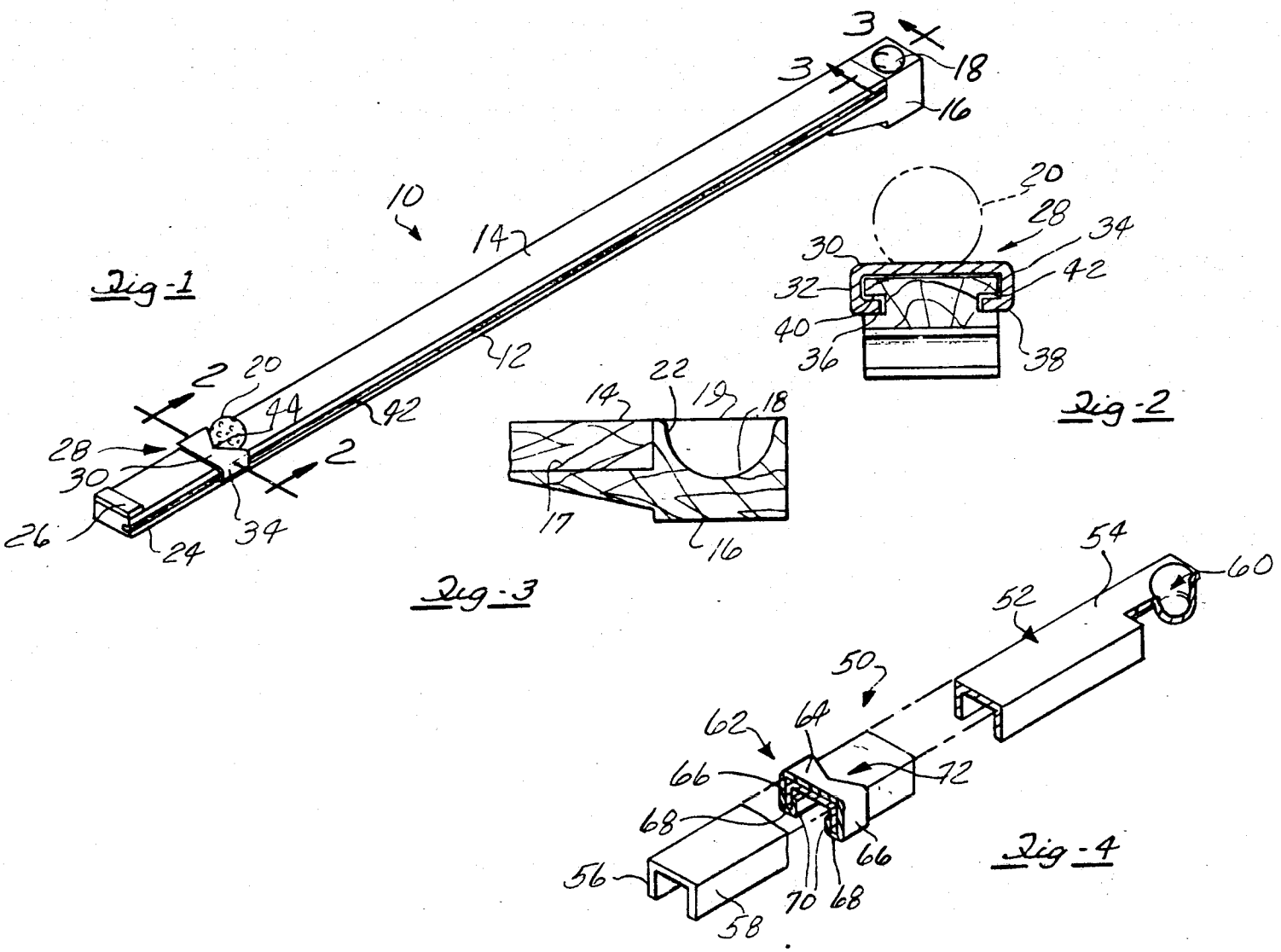
FIG. 1 illustrates a perspective view of the practice putting trainer of the present invention.
FIG. 2 illustrates a cross-sectional view of the practice putting trainer of FIG. 1 taken along the line 2—2 of FIG. 1.
FIG. 3 illustrates a broken cross-sectional view of the practice putting trainer of FIG. 1 taken along the line 3—3 of FIG. 1.
FIG. 4 illustrates a broken, perspective, partially sectioned view of an alternate embodiment of a practice putting trainer of the present invention.

Referring now to the drawing, there is illustrated in FIG. 1 one example of the present invention in the form of a practice putting trainer 10. The practice putting trainer 10 is adapted to quickly improve the putting of a golfer utilizing the trainer 10 as described herein below. The practice putting trainer 10 comprises an elongated, narrow, planar base 12 having sufficient stiffness to support a golf ball without perceptible deflection. A flat ball engaging putting surface 14 is provided along an upper portion of the base 12, and the base includes a thickened end 16 having a recess formed therein to provide a cup 18 to receive a golf ball 20. As shown in FIG. 3, an edge 22 of the cup 18 is made sharp to allow a properly struck golf ball 20 to drop into the cup 18, and an improperly struck ball having too much speed to enter and leave the cup. Another end 24 of the base 12 includes a flange 26 overlaying the putting surface 14 to retain a ball rest 28 slidingly positionable along the surface 14 as will be more fully described subsequently. The flange 26 and the base 12 are permanently joined using a fastener such as nails, or adhesive, or both.

Referring again to FIG. 3, the thickened end 16 includes a notch 17 formed therein complementary to an end of the base 12. The putting surface 14 is positioned flush with an upper surface 19 of the thickened end 16 to provide a smooth transition between the putting surface and the thickened end. The base 12 and the thickened end 16 are premanently joined using fasteners such as nails or an adhesive or both. When placed on the floor, the thickened end 16 raises the cup slightly to provide a modest incline that the ball must traverse to enter the cup. This encourages the user to firmly strike the ball.

The putting trainer 10 further includes ball rest 28 slidable along the base 12 to vary the length of putt. The ball rest 28 includes a top wall 30, a pair of opposed downward extending side walls 32, 34 integral with the top wall 30, and a pair of opposed inward extending flanges 36, 38 integral with the side walls 32, 34. A pair of opposed groves 40, 42 are formed along sides of the base 12 to slidingly receive the pair of opposed inward extending flanges 36, 38 as shown in FIG. 2 of the drawing and allow the ball rest 28 to be retained on the base 12 and slidable along the putting surface 14. A forward edge of the top wall 30 includes a recess 44 formed therein to secure the ball 20 against transverse rolling and hold the ball in the center of the putting surface 14 until struck by the blade of a putter.

A properly struck ball 20 will roll along the putting surface 14 rotating about an axis parallel to the putting surface 14 and perpendicular to the longitudinal axis of the base 12. If the ball 20 is improperly struck by the blade of the putter and the ball is caused to spin about a vertical axis, the ball will roll only a short distance before dropping from the putting surface 14. The width of the putting surface 14 is approximately equal to the diameter of a golf ball or slightly larger so that the golfer can use the putting surface 14 as a guide to aid in a straight follow-through of the club avoiding motions that would cause the ball 20 to spin about a vertical axis. The narrow configuration of the putting surface 14 also aids the golfer in keeping the blade of his putter perpendicular to the longitudinal axis of the putting surface 14.

Referring now to FIG. 4 of the drawing, there is illustrated at 50 an alternate embodiment of the practice putting trainer of the present invention comprising a base 52 formed in an inverted "U" channel like shape including an upper wall 54 and a pair of opposed downward extending longitudinal side walls 56, 58 integral with the upper wall 54. The upper surface of the upper wall 54 constitutes a putting surface and is made essentially flat and planar. A cup 60 is formed in an upper end of the base 52 with a slightly rounded edge to simulate an actual cup on a green and to aid in allowing a properly struck ball to enter the cup. A ball rest 62 is provided that is movable along the upper wall 54 in abutment therewith. The ball rest 62 comprises a horizontal wall 64 in abutment with the upper wall 54, a pair of downward depending walls 66 integral with the horizontal wall 64, a pair of inward extending walls 68 integral with the downward depending wall 66, and a pair of upward extending walls 70 integral with the inward extending walls 68 to slidingly embrace the longitudinal side walls 56, 58. A V-shaped recess 72 is formed along a forward edge of the horizontal wall 64 to retain a ball 20 that is rested thereagainst. Movement of the ball rest 62 along the base 52 adjusts the length of the putt that the golfer attempts.

The embodiment illustrated in FIG. 4 of the drawing may be readily made from a metal stamping, such as steel or aluminum, a metal or plastic extrusion, or injection molded plastic. The embodiment illustrated in FIGS. 1,2 and 3 is preferably made from wood although injection molded plastic could also be used. It would be obvious to the skilled artisan that other manufacturing methods and materials may be used to form the devices described hereinabove, and the practice of the present invention is not necessarily limited to those described and illustrated.

It can thus be seen that the present invention has provided a new and improved practice putting trainer wherein a golfer can quickly determine what he is doing that prevents him from having a good putting stroke and can easily and quickly become a skilled putter. A practice putting trainer of the present invention is very economical and inexpensive to produce and easy to use.

It should be understood by those skilled in the art of practice putting trainers that other forms of the Applicant's invention may be had, all coming within the spirit of the invention and the scope of the appended claims.

Having thus described my invention what I claim is:

1. A practice putting trainer comprising:

an elongated, narrow, planar base having sufficient stiffness to support a golf ball without perceptible deflection;

a flat ball engaging putting surface formed along an upper portion of the base, said putting surface having a width substantially equal to the diameter of a golf ball;

a cup for receiving the golf ball disposed at one end of the base; and a ball rest including a means for retaining the golf ball on the putting surface until struck by a putter; and wherein a golf ball rolling along the length of the base from the ball rest to the cup will roll off of the sides of the putting surface if hit improperly.

2. The practice putting trainer as defined in claim 1 further comprising:

means for adjustably positioning the ball rest along the length of the base.

3. The practice putting trainer as defined in claim 2 wherein the means for adjustably positioning the ball rest along the base comprises the ball rest having a top wall abutting said putting surface and a pair of opposed, depending side walls slidingly engaging opposed sides of said base.

4. The practice putting trainer as defined in claim 3 wherein the means for retaining the golf ball on the putting surface comprises a recess formed along a forward end of said top wall of said ball rest with the edges of said recess preventing lateral movement of said ball when said ball is in abutment therewith.

5. The practice putting trainer as defined in claim 2 further comprising:

the base of laminar construction;

a thickened end including a notch complementary to the base abutting an end of the base, an upper surface of said thickened end flush with said putting surface, a recess formed in the thickened end forming a cup to receive a golf ball; and a flange attached to another end of the base, said flange retaining said ball rest.

6. The practice putting trainer as defined in claim 1 wherein an edge of the cup is slightly rounded to simulate a cup formed in a golf green and to allow entry of a properly struck ball and to cause a ball that is traveling too fast to enter and leave the cup.

7. The practice putting trainer as defined in claim 1 wherein:

the one end of the base has an enlarged thickness so as to dispose the base at an upward inclined angle from the ball rest to the cup.

8. A practice putting trainer comprising:

an elongated, narrow, planar base with a cup recessed to receive a golf ball at one end, a flat putting surface formed along an upper portion thereof, said base having sufficient stiffness to support a golf ball without perceptible deflection;

an edge of said cup being slightly rounded to encourage the entry of a properly struck golf ball having the correct speed and to allow an improperly struck golf ball having too much speed to enter and leave the cup; and a ball rest including downward extending opposed side walls slidingly engaging said base and a top wall abutting said putting surface, a recess formed along a forward edge of said top wall to position the golf ball on said base while preventing transverse rolling of the golf ball, said ball rest being longitudinally movable along said base to selectively vary the distance from said ball rest to said cup.

9. The practice putting trainer as defined in claim 8 wherein the base is formed from wood including a thick end providing sufficient material to form the cup therein, a flange overlaying the putting surface to retain said ball rest on the putting surface inclined upward toward said one end, a pair of opposed longitudinal recesses formed along sides of the base, and a pair of opposed inward directed projections associated with said ball rest and engageable with said opposed longitudinal recesses.

* * * * *